US006158828A

United States Patent [19]

Vacovsky et al.

[11] Patent Number: 6,158,828

[45] **Date of Patent: *Dec. 12, 2000**

[54] JERSEY DISPLAY FRAME

[75] Inventors: Kurt A. Vacovsky, Phoenix; John A. Bennett, Baltimore, both of Md.

[73] Assignee: Picture Perfect, Towson, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 08/880,365

[22] Filed: Jun. 23, 1997

[51] Int. Cl.[7] ..... A47F 3/00

[52] U.S. Cl. ..... 312/114; 40/800

[58] Field of Search ..... 312/114, 257.1, 312/4, 102, 204; 40/661, 661.04, 800, 725, 771; 190/107, 13 R, 100, 102; D6/315, 319; 223/88, 92

[56] References Cited

U.S. PATENT DOCUMENTS

| | | | |
|---|---|---|---|
| 1,348,952 | 8/1920 | Landry | 40/661.04 X |
| 1,392,634 | 10/1921 | Goldberg | 223/88 |
| 2,622,774 | 12/1952 | Freeman | 223/92 |
| 3,463,368 | 8/1969 | Quisling | 223/88 |
| 3,549,063 | 12/1970 | Campbell | 223/88 |
| 3,792,543 | 2/1974 | Powell | 40/800 |
| 4,615,447 | 10/1986 | Walter | 223/92 X |
| 4,782,947 | 11/1988 | Sheiman | 190/13 R X |
| 4,831,754 | 5/1989 | Tallent | 40/800 |
| 5,165,538 | 11/1992 | Peters | 40/661 X |
| 5,244,131 | 9/1993 | Hollingsworth | 223/92 X |
| 5,469,967 | 11/1995 | Boorady | 190/107 X |
| 5,690,402 | 11/1997 | Koppe | 312/114 X |

OTHER PUBLICATIONS

Advertising Brochure "Pro Products" (No Date Given).

Advertising Brochure "Showcase" by Lin Terry (No Date Given).

Advertising Brochure (No Date Given).

*Primary Examiner*—Peter M. Cuomo
*Assistant Examiner*—James O. Hansen
*Attorney, Agent, or Firm*—Sughrue, Mion, Zinn, Macpeak & Seas, PLLC

[57] ABSTRACT

A jersey display frame for displaying the jersey of a uniform in a life-like manner with a three-dimensional view. The display frame includes a frame body and support member fixed to the frame body for supporting the jersey within the display frame. The support member includes a predetermined width, height and depth to provide the visual perception of the jersey in a life-like manner. For example, a football jersey is displayed such that it is visually perceived as it is supported on shoulder pads. The display frame is customized to display all types of jerseys. A hook is threadedly engaged in the support member and is adjustable to allow the jersey to be properly positioned within the display frame.

12 Claims, 4 Drawing Sheets

JERSEY DISPLAY FRAME

BACKGROUND OF THE INVENTION

The present invention relates in general to a display frame. More particularly, the present invention is directed to a jersey display frame for displaying in a life-like manner the jersey of a uniform, such as a football, baseball or hockey jersey.

There is known in the art display cases for displaying all sorts of memorabilia items, including sporting items, such as balls, hockey pucks, uniforms, trophies, and so on. The jersey of a football uniform, for example, is one type of item that is commonly displayed in a display case. Such display cases, which are also known as shadow boxes, jersey cases, jersey displays or shirt cases, etc., typically frame an athlete's jersey, which is then mounted on a wall or otherwise displayed for open viewing. In some instances, the jersey is autographed by the athlete. Display cases are commonly found in commercial establishments, such as sporting restaurants and bars.

In general, the jersey is stitched to a backing (e.g., mat board or paper-type product) or the like and is enclosed by a glass or acrylic cover. There is known a shirt case by Lin Terry, 59 East Madison Avenue, Dumont, N.J., that is made of an acrylic material to provide a view of the jersey from both the front and back perspectives. In that display case, the jersey is hung from a hanger.

In all of the conventional display cases known, including the display case in which the shirt is stitched to the backing material or the display case sold by Lin Terry, the jersey is displayed without regard to the manner in which it is actually worn by the individual. For instance, when the jersey is stitched to the backing, the shirt is firmly pressed against the backboard within the display case. Similarly, in the display case sold by Lin Terry, the jersey simply hangs from the hanger and droops down within the display case. In both instances, the jerseys are displayed only from one perspective. That is, there is no third dimension or depth perspective provided. Thus, while the autographed jerseys and the like can be displayed, they are not displayed in an authentic or life-like manner.

SUMMARY OF THE INVENTION

Accordingly, it is a general object of the present invention to provide a display frame for the display of an item, such as a jersey, in a three dimensional manner, which is free of the above and other problems associated with the conventional display cases.

It is a further object of the present invention to provide a jersey display case which simulates the actual wearing of a jersey by an athlete in a life-like manner.

It is even a further object of the present invention to provide a display case for the display of an article of clothing such as a dress, gown, shirt, or other similar types of attire suitable for such display.

To accomplish the above and other objects of the present invention, there is provided a display frame for displaying an item. The display frame includes a frame including a backing and front cover made of a transparent material, a support member supporting the item for display within the display frame, and including a hook for attaching the support member to said frame. The support member has a predetermined width, height, and depth sufficient to display said item in a life-like manner.

DETAILED DESCRIPTION OF A PREFERRED EMBODIMENT

Figure 1:
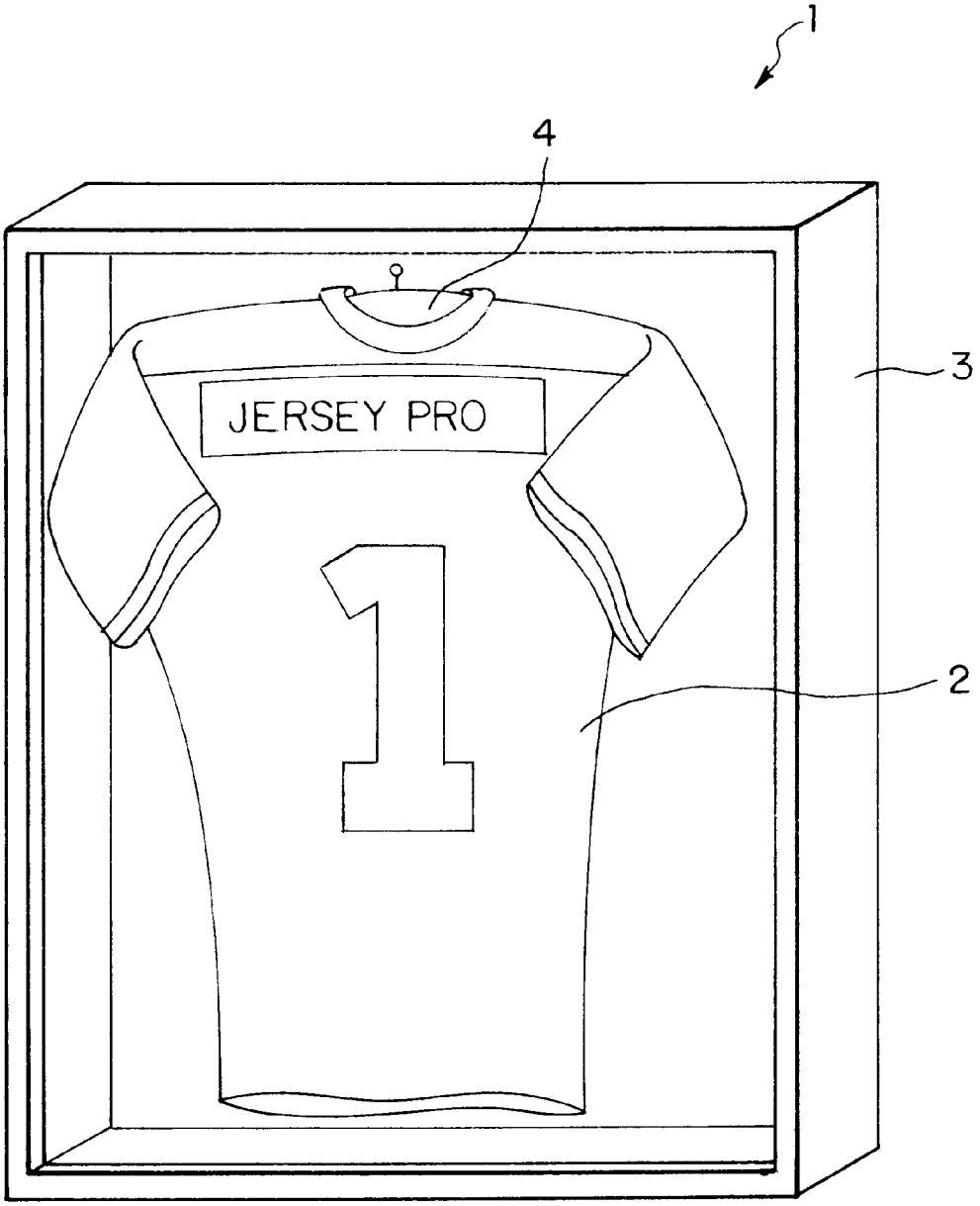
FIG. 1 illustrates a jersey display frame in accordance with a preferred embodiment of the present invention.

Referring to FIG. 1, there is shown a jersey display frame for use in displaying a jersey 2 in accordance with a preferred embodiment of the present invention. The display frame includes a frame body 3 and a support member 4 for holding the jersey 2 in a realistic, life-like fashion. The support member 4 is custom designed so that the jersey is displayed in three-dimensions. Further, the support member supports the jersey so that all of the lettering (e.g., individual's name on the back of the jersey) or team logo is clearly visible. For example, the support is designed so that the phrase "Jersey Pro" (™) appearing on the jersey in FIG. 1 is clearly legible. The display frame is applicable for display any type of item such as sports-related of jerseys, for all sports, recreation activities, clubs, and so on. For example, the display frame can display the jersey for football, hockey, baseball, basketball, lacrosse, golf, jockeys, car racing drivers, etc. The display fram can also display gowns, dresses, shirts, outfits, and all other similar types of wardrobe and attire.

More particularly, as illustrated in FIG. 1, the jersey display frame according to a preferred embodiment of the present invention displays a jersey to simulate the manner in which it is actually worn by the athlete. For example, a football jersey is displayed so as to simulate the wearing of the jersey over shoulder pads. Similarly, a hockey jersey is displayed in such a manner that it appears as if shoulder pads are actually within the jersey. Although baseball players do not wear shoulder pads, the jersey is nonetheless displayed to simulate the jersey on a player having broad shoulders. Accordingly, the jersey display case according to the present invention displays the uniform's jersey in a life-like manner. That is, the frame provides a three-dimensional display of the jersey.

Figure 2:
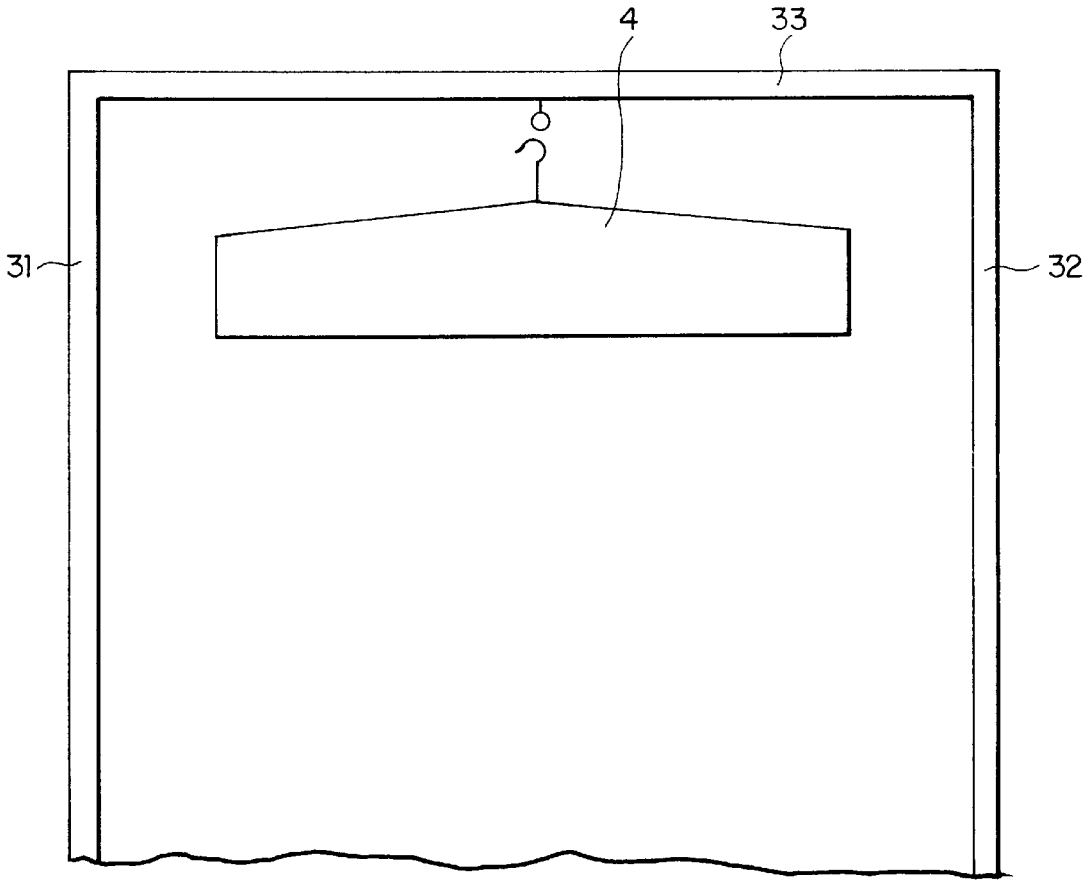
FIG. 2 illustrates a front view of the display frame of FIG. 1.

FIG. 2 illustrates a front view of the frame body 3 of the display frame 1. The frame includes left and front sides 31, 32, and top and bottom sides 33, 34. By way of example only, the frame has an approximate size of 40 inches high and 32 inches by width. The frame is preferably made of wood, but other suitable materials may be used as well. In another embodiment, the display frame and all components (e.g., the support hanger 4 and jersey to be displayed) are considerably smaller in size to display a correspondingly smaller replicate of a jersey.

Figure 3:
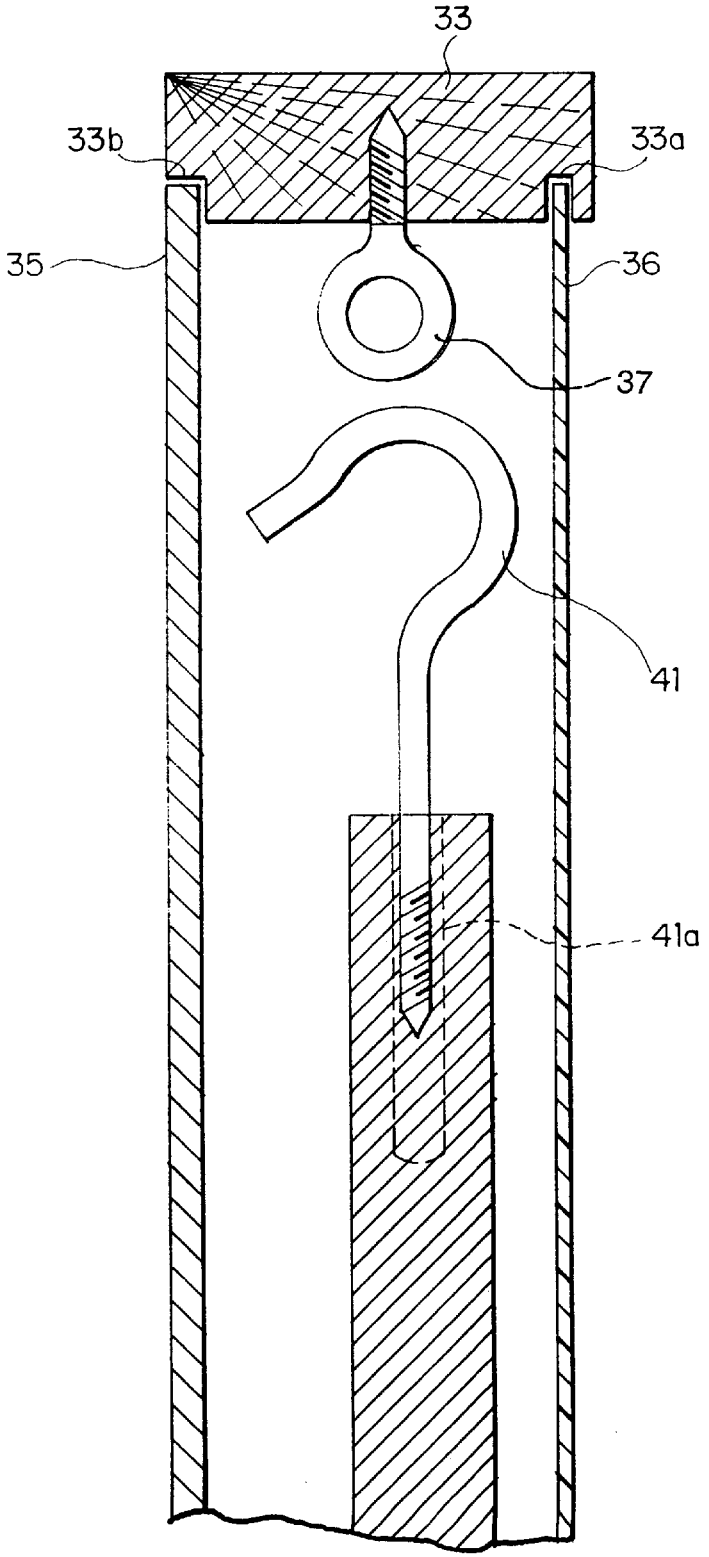
FIG. 3 illustrates a support member for use in the display frame of FIG. 1.

The top and bottom portion 33, 34 each include grooved portions for receiving the front plate 36 and rear backing 35, as shown FIG. 3. Each of the top and bottom portions 33,34 includes a first groove 33*a*, 34*a* for receiving the front plate 36, which is preferably made of a plexi-glass material, and second groove 33*b*, 34*b*formed on the rear portion of the top and bottom portions to receive the backing 35. The backing on the frame is attached in such a way to permit easy access to the jersey from the rear to arrange the jersey and to allow removal and replacement of the jersey.

As shown in FIGS. 2 and 3, the top plate 33 includes a hook member 37 that is attached to the top plate 33. The hook member may be threadedly engaged into the top plate 33 as shown best in FIG. 3 or by other suitable means.

Figure 4:
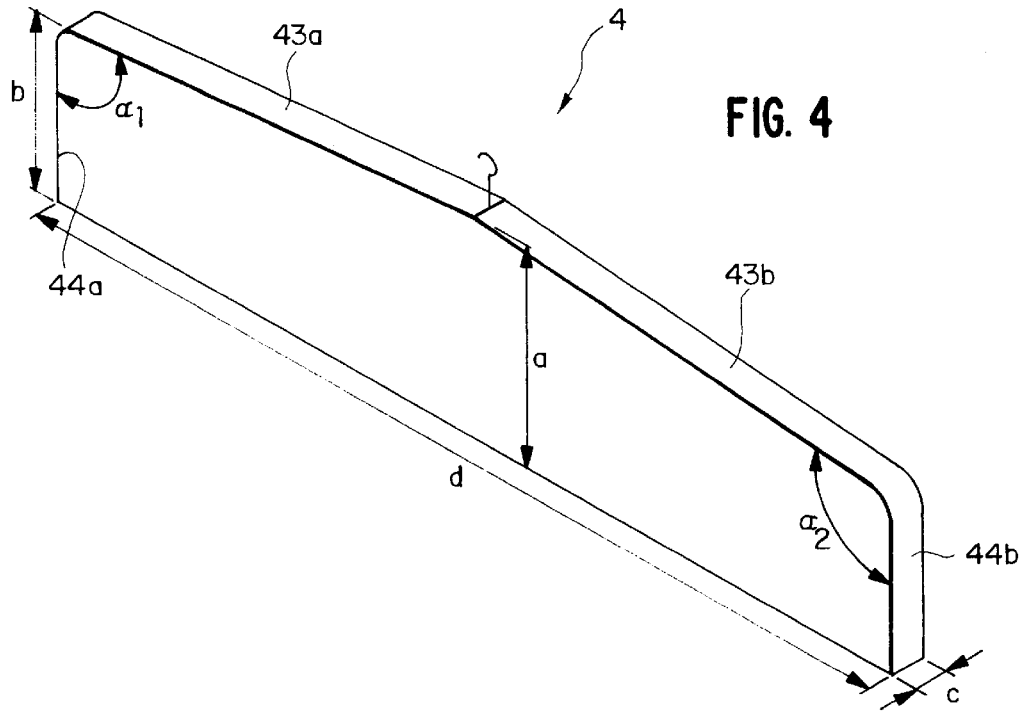
FIG. 4 illustrate a support hanger of the display frame of FIG. 1 according to a first embodiment of the present invention.
Figure 5:
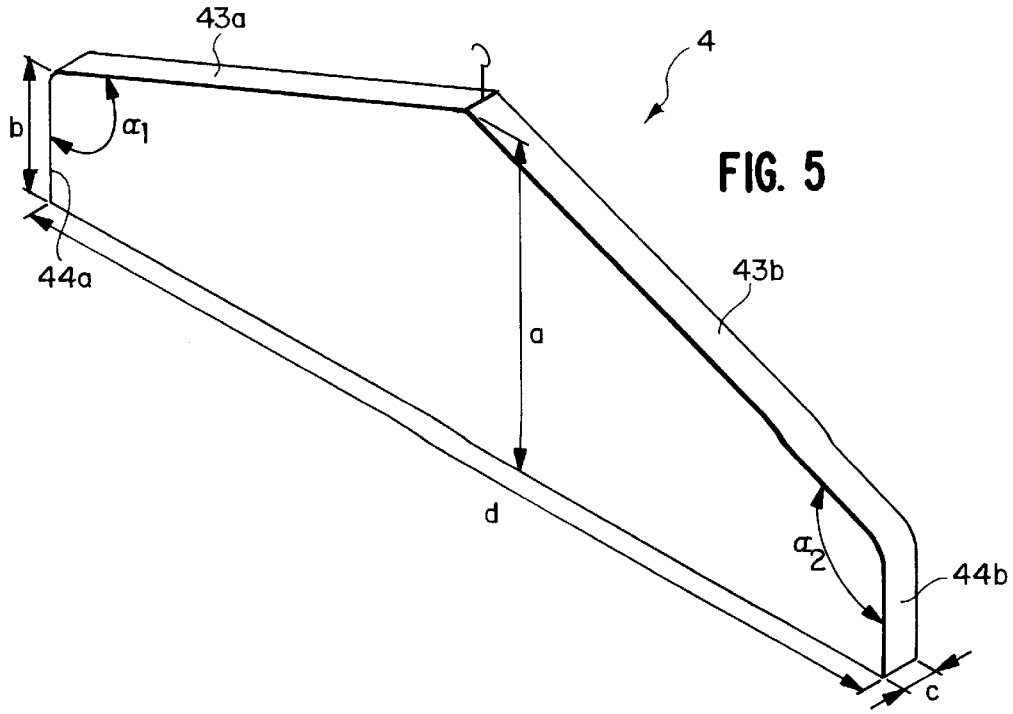
FIG. 5 illustrates a support hanger of the display frame of FIG. 1 according to a second embodiment of the present invention.

FIGS. 4 and 5 illustrate preferred first and second embodiments of the support member 4. The support members are designed in relation to the type of jersey that is to be displayed. For example, FIG. 4 illustrates a support member for a football jersey, wherein the support member is designed so as to provide the perception that the shoulder pads are inside of the football jersey, as it would actually be worn by the athlete. On the other hand, FIG. 5 illustrates a support member for a baseball jersey or other type of shirt which is not worn with shoulder pads. Further, the support members illustrated in each of FIGS. 4 and 5 is designed so that the individual's name printed on the back of the jersey and the team's logo are clearly visible.

Referring to FIG. 4, there is shown the support member 4 in accordance with a preferred embodiment of the present invention. The support member includes a hook 41 and support body 42. The support body 42 includes right and left lateral edges 43*a*, 43*b* and right and left portions 44*a*, 44*b*. As illustrated more clearly in FIG. 3, the hook 41 is received by a predrilled hole 41*a*. The hook can be screwed a variable distance so that the height of the jersey and support member within the display frame can be adjusted.

The actual dimensions of the support members of a football jersey and baseball jersey, respectively, as generally shown in FIGS. 4 and 5, are provided in the following Table for exemplary purposes only.

| Dimensions | Football Jersey | Baseball Jersey |
|---|---|---|
| a | 5.375" | 8.124" |
| b | 4" | 3.5" |
| c | 0.75" | 0.75" |
| d | 23" | 21" |
| α1 | 98° | 115° |
| α2 | 98° | 115° |

There has thus been shown and described a novel jersey display case which fulfills all the objects and advantages sought therefor. Many changes, modifications, variations and other uses and applications of the subject invention will, however, become apparent to those skilled in the art after considering the specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. A display frame for displaying an item, said display frame comprising:

a frame including a backing made of an opaque material, a front cover made of a transparent material, and a hook member fixed to the frame; and a support member capable of supporting the item for display within said display frame, said support member comprising a bottom portion, left and right portions, and a top portion including left and right lateral edges having a predetermined width, wherein a first end of said left and right lateral edges abut one another to form an apex at approximately a center of said top portion, and a second end of said left and right lateral edges abut said left and right portions, respectively, at a predetermined angle, such that the apex of said top portion is a predetermined distance from said bottom portion, and wherein said predetermined width, angle and distance are selected to conform said support member to the item, said support member further comprising a hook at the apex for attaching said support member to said hook member.

2. A display frame as defined in claim 1, wherein said item is a jersey.

3. A display frame as defined in claim 2, wherein said predetermined width, angle and distance are defined to provide the visual perception that said jersey is supported on shoulder pads.

4. A display frame as defined in claim 2, wherein said predetermined width, angle and distance are defined to provide the visual perception of said jersey as said jersey is worn by an individual.

5. A display frame as defined in claim 2, wherein said hook is threadedly engaged in said support member, said hook being adjustable in length relative to said support member so as to vary the positioning of said jersey within said display frame.

6. A display frame as defined in claim 2, wherein said front cover is made of plexi-glass.

7. A display frame as defined in claim 2, wherein said backing is removable for access within said display frame.

8. A display frame as defined in claim 2, wherein said jersey is one of a football, hockey, baseball, lacrosse, basketball, and golf jersey.

9. A display frame as defined in claim 2, wherein said predetermined width, distance and angle equal about 23 inches, 5.375 inches, and 98 degrees, respectively.

10. A display frame as defined in claim 2, wherein said predetermined width, distance and angle equal about 21 inches, 8.125 inches, and 115 degrees, respectively.

11. A display frame as defined in claim 2, wherein said support member has a predetermined depth, sufficient to display said jersey in three dimensions.

12. A display frame comprising:

a plurality of items, wherein one of said items is selected to be displayed within said display frame;

a frame including a backing made of an opaque material, a transparent front cover and a hook member fixed to the frame; and one of a plurality of support members capable of supporting one of said items for display within said display frame, each of said plurality of said support member comprising a bottom portion, left and right portions, and a top portion including left and right lateral edges having a predetermined width, wherein a first end of said left and right lateral edges abut one another to form an apex at approximately a center of said top portion, and a second end of said left and right lateral edges abut said left and right portions, respectively, at a predetermined angle, such that the apex of said top portion is a predetermined distance from said bottom portion, and wherein said predetermined width, angle and distance are selected to conform said support member to the item said support members further comprising a hook at the apex for attaching said support member to said hook member.

* * * * *